United States Patent [19]

Otsuka et al.

[11] Patent Number: 4,754,955

[45] Date of Patent: Jul. 5, 1988

[54] AIR CUSHION SNUBBER APPARATUS

[75] Inventors: Tsuruo Otsuka, South Holland; Edward J. Brzezniak, Lyons, both of Ill.

[73] Assignee: Verson Allsteel Press Company, Chicago, Ill.

[21] Appl. No.: 426,234

[22] Filed: Sep. 28, 1982

Related U.S. Application Data

[63] Continuation of Ser. No. 148,738, May 12, 1980, abandoned.

[51] Int. Cl.[4] ..... F16F 9/02

[52] U.S. Cl. ..... 267/119; 72/453.13; 72/465; 83/617; 173/139; 188/284; 188/314; 267/64.15; 267/64.25; 267/130

[58] Field of Search ..... 188/284, 297, 311, 314, 188/315; 267/119, 130, 137, 64.25, 64.15, 64.26; 72/351, 465, 453.13; 137/494, 529; 92/85 B; 173/139; 83/617

[56] References Cited

U.S. PATENT DOCUMENTS

| | | | |
|---|---|---|---|
| 1,602,411 | 10/1926 | Rode | 267/119 X |
| 1,623,431 | 4/1927 | McVoy | 137/529 X |
| 2,584,339 | 2/1952 | Georgeff | 267/119 |
| 2,606,630 | 8/1952 | Rossman | 188/284 |
| 3,097,838 | 7/1963 | Andrews | 188/313 X |
| 3,171,640 | 3/1965 | Perrone | 267/119 |
| 3,359,024 | 12/1967 | Morgan | 137/494 X |
| 3,740,997 | 6/1973 | Blake et al. | 267/119 X |
| 3,760,955 | 9/1973 | Hawthorne | 267/64.15 X |
| 3,923,294 | 12/1975 | Gold et al. | 267/119 |
| 3,962,895 | 6/1976 | Rydell | 267/119 X |

*Primary Examiner*—George E. A. Halvosa
*Attorney, Agent, or Firm*—Jerry W. Mills

[57] ABSTRACT

An improved snubber apparatus for an air cushion within a forming press is provided. A floating piston is mounted within the air cushion and defines a snubbing chamber. As the air cushion returns to its top stroke position after yieldably deforming to cushion a member within the forming press, a movable piston within the air cushion contacts the floating piston, forcing it to move in the direction reducing the volume of the snubbing chamber. A check valve is provided between a cushion chamber and the snubbing chamber which maintains the pressure in the snubbing chamber at a minimum equivalent to the pressure in the cushion chamber. As the volume of the snubbing chamber is reduced, the air trapped within is rapidly compressed to a value snubbing the motion of the air cushion. The snubber valve is provided communicating with the snubbing chamber and maintained in a closed position by the air pressure within the cushion chamber. During the snubbing action, when the air pressure within the snubbing chamber reaches a predetermined value, the snubber valve is opened permitting the air from the snubber chamber to escape through the valve to the surrounding atmosphere. An orifice plug is provided to control the outflow of the air when the valve is open. The relative cross-sectional areas exposed to the air pressure within the cushion chamber and the snubbing chamber on the snubber valve are varied to correspond to the number of cushion chambers in the air cushion.

31 Claims, 3 Drawing Sheets

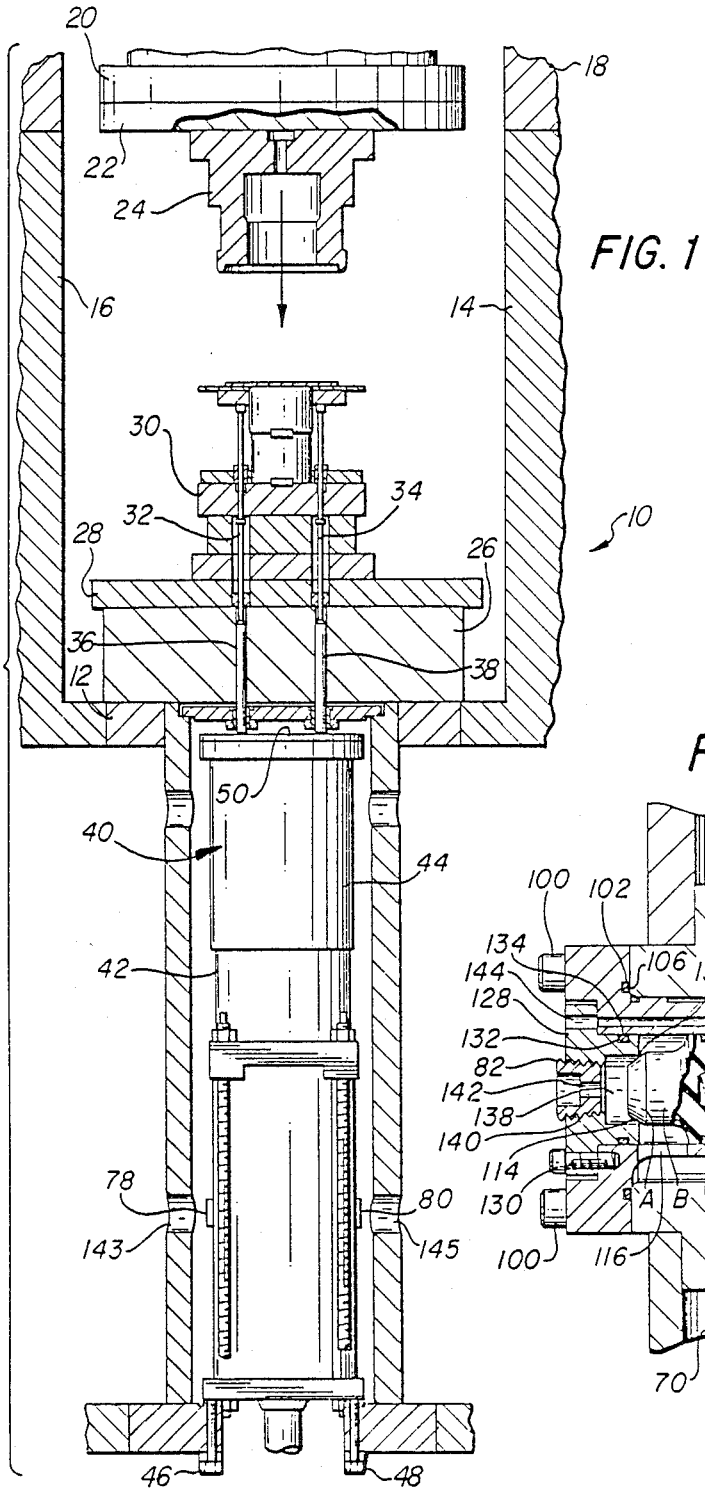
FIG. 1
FIG. 4
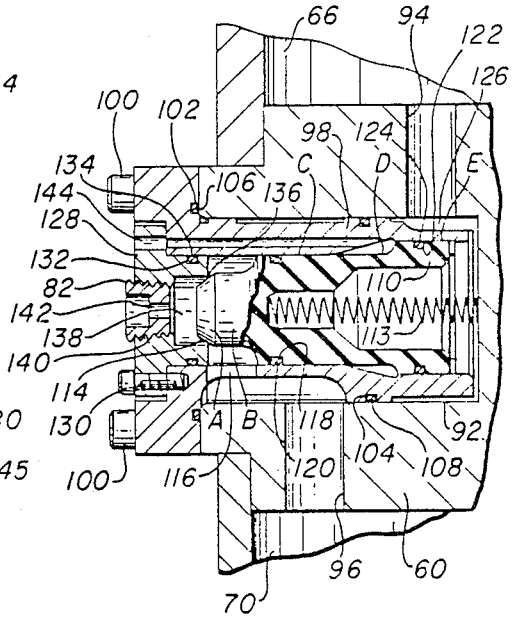

AIR CUSHION SNUBBER APPARATUS

CROSS-REFERENCE TO RELATED APPLICATIONS

This application is a continuation of parent application Ser. No. 148,738, filed May 12, 1980, now abandoned.

TECHNICAL FIELD

The present invention relates to a snubber apparatus and particularly to a snubber apparatus for use in an air cushion in a forming press.

BACKGROUND ART

Forming presses are widely used to form metals and other materials into shaped products. Typically, the material to be formed is placed in a lower die resting on the bed of the forming press and formed into the finished product by forces exerted by an upper die mounted on a movable and massive slide reciprocating in the press.

Air cushions are used in forming presses to provide blank holding for drawing metals or other materials and as ejectors to raise parts out of the lower dies. The air cushion is depressed by the moving top die, which contacts the air cushion through cushion pins directly or with the work piece therebetween. The stroke length of the air cushion is rarely in excess of one half the stroke of the slide holding the top die. Therefore, the air cushion does not begin to be depressed until a given point of the down stroke of the press slide is reached. Similarly, the air cushion returns to its top stroke position at some point on the return stroke of the press slide.

The air cushion would be subject to a severe impact upon its return to its top stroke position, therefore systems have been developed for snubbing the motion of the air cushion returning to its top stroke position. It is desirable to decelerate the moving air cushion as quickly as possible with the minimum amount of impact. These prior snubbing systems have compressed air at atmospheric pressure within a chamber fitted with a small orifice to form the snubbing action. With air at atmospheric pressure, a substantial compression ratio is necessary within the snubbing chamber to equalize the cushion force developed within the air cushion. In order to accomplish this task, the chamber has been fitted with a small orifice to prevent too much air escapement while air is being compressed within the snubbing chamber. It is therefore apparent that the time necessary for the last increment of air cushion travel near the top stroke position on the return stroke varies over a very broad range when the air cushion pressure and cushion return velocity varies.

Therefore, a need has arisen for a snubbing system which provides snubbing of the air cushion as it returns to its top stroke position which provides deceleration within a controlled time period with minimal variation due to the change in cushion pressure and cushion return velocity.

DISCLOSURE OF THE INVENTION

In accordance with the present invention, a snubber apparatus for snubbing the motion of a member in a forming press is provided. The snubber apparatus comprises a snubber valve communicating with a snubbing chamber in the forming press, the volume of the snubbing chamber being variable in response to the motion of the moving member. The snubber apparatus further comprises compressible material within the snubbing chamber and means biasing the snubber valve means in the closed position, thereby preventing flow of the compressible material through the valve. The snubber apparatus acts to snub the motion of the moving member by the action of the compressible material within the snubbing chamber as the snubbing chamber volume is varied. The compressible material causes the snubber valve to open at a predetermined compression value and thereby permit flow of the compressible material through the valve to alleviate the snubbing of the motion of the moving member.

In accordance with another aspect of the present invention, a snubber apparatus is provided for a cushion assembly having at least one cushion chamber. The cushion chambers have compressed air therein. The cushion assembly yieldably deforms to cushion a member in a forming press. The snubber apparatus comprises a snubber valve communicating with a snubbing chamber within the cushion assembly. The snubbing chamber volume varies in response to the deformation of the cushion assembly and also has compressed air therein. The snubber apparatus further comprises means biasing the snubber valve in the closed position to prevent air flow through the valve, when cushion is in static (non-moving) state at any position of cushion to minimize loss of compressed air with the air in a cushion chamber forming a portion of the biasing means. The deformation of the cushion assembly is snubbed by the action of the air within the snubbing chamber as the snubbing chamber volume varies. At a predetermined air pressure, the air within the cushion chamber opens the snubber valve and permits air flow through the snubber valve to alleviate the snubbing of the cushion assembly. As the air flows through the snubber valve, it passes through a orifice of predetermined cross-sectional area to control the rate of air flow through the snubber valve means.

In accordance with yet another aspect of the present invention, a method for snubbing the motion of a member in a forming press is provided which comprises the steps of forming a snubbing chamber having a volume variable in response to the motion of the member and supplying air to the snubbing chamber at a first predetermined pressure. The method further comprises the steps of providing snubber valve means to communicate with the snubbing chamber and biasing the snubbing valve means in a closed position to prevent airflow therethrough. The method further comprises the steps of decreasing the volume of the snubbing chamber to compress the air therein and snub the motion of the member and opening the snubber valve means to permit flow of the air through the snubber valve means when the air within the snubbing chamber reaches a second, higher predetermined pressure to alleviate the snubbing of the member.

BRIEF DESCRIPTION OF THE DRAWINGS

The advantages and further aspects of the present invention will be readily appreciated by those of ordinary skill in the art as the same becomes better understood by reference to the following Detailed Description when considered in connection with the accompanying drawings in which:

FIG. 1 is a vertical cross-sectional end view of a portion of a forming press;

FIG. 4 is an enlarged view of a portion of the air cushion illustrated in FIG. 2 illustrating the snubber valve of the present invention;

DETAILED DESCRIPTION

Figure 2:
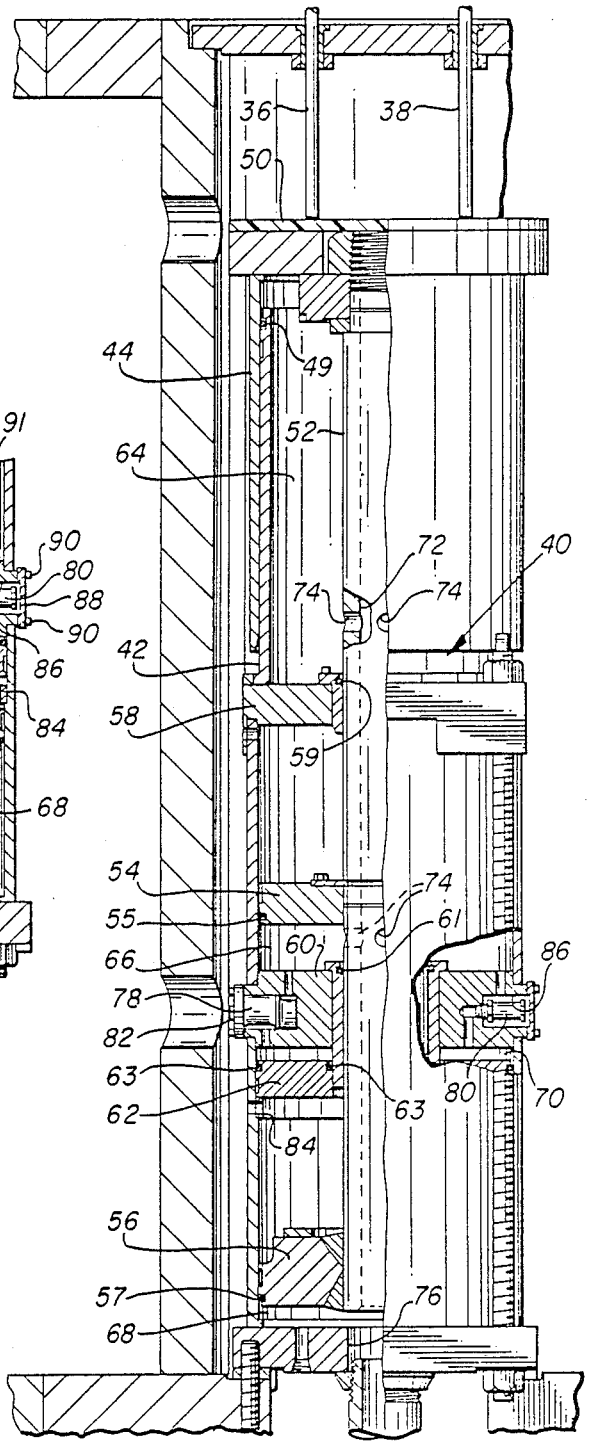
FIG. 2 is a vertical cross-sectional side view of an air cushion illustrating the snubber apparatus of the present invention.

Referring now to the drawings, wherein like reference characters designate like or corresponding parts throughout several view, there is shown in FIG. 1 a forming press 10 in which the apparatus of the present invention is employed. The forming press 10 may be of either a hydraulic or mechanical type and may be used to form metals or other materials.

In a typical forming press of the type illustrated in FIG. 1, the frame of the press 10 comprises a bed 12, two columns 14 and 16 (not shown) rising vertically from either side of bed 12 and a crown portion 18 (not shown) interconnecting the top ends of columns 14 and 16. A press slide 20 is mounted below the crown 18 for reciprocating vertical motion. A commonly employed manner of imparting this vertical reciprocating motion is by rotatably mounting a disk having an eccentric pin in crown 18. The eccentric pin slidably engages a horizontal slot within the slide 20 so that rotational motion of the disk imparts a reciprocating vertical motion to slide 20. The slide 20 is typically formed of a high density material to provide tremendous energy transference to the material to be formed.

The lower end of slide 20 may be provided with a slide adaptor plate 22 for securing an upper die 24 thereon. A bolster 26 is typically provided at the top of bed 12, and may have a bolster subplate 28 on top of bolster 26. Bolster subplate 28 in turn supports lower die 30. Slide adaptor plate 22 and subplate 28 are provided only to permit the dies to be quickly changed and may be deleted. Material to be formed is placed on the upper surface of lower die 30 and draw pad 31 when slide 20 is near the top of tis reciprocatory motion. During the lower part of the reciprocatory motion of slide 20, upper die 24 and lower die 30 are in intimate contact and form the material into the desired shape.

Bolster 26, bolster subplate 28 and lower die 30 are formed with aligned vertical passages permitting the insertion of the pins 32 and 34 and bolster pins 36 and 38. The upper portions of die pins 32 and 34 may be used to provide blank holding for drawing metals or as ejectors to raise the work piece parts out of the lower die. The lower ends of die pins 32 and 34 contact the upper ends of bolster pins 36 and 38. The lower ends of bolster pins 36 and 38 contact the upper surface of air cushion 40.

Air cushion 40, which is essentially an air spring, provides the necessary force permitting die pins 32 and 34 to hold blanks for drawing metals and eject a work piece from the lower die. The air cushion 40 is depressed by the closing action of the upper and lower dies 24 and 30 acting on die pins 32 and 34.

In order to describe the operation of air cushion 40 in relationship to the remainder of forming press 10, a full cycle of the reciprocatory motion of slide 20 is contemplated with the cycle beginning with slide 20 in its uppermost postion. At this point, the upper and lower dies 24 and 30 are separated, and the material or work piece to be formed is placed on the lower die, either by an automated machine or other means. At some point in its downward movement, slide 20 reaches a position where upper die 24 comes into contact with lower die 30 through the work piece. At this point, upper die 24 contacts the air cushion 40 in its top stroke position through draw pad 31 and die and bolster pins 32, 34, 36 and 38. The slide 20 continues its downward motion, causing dies 24 and 30 to form the material into the desired shape. During this downward motion, air cushion 40 is continuously being depressed and resists this motion with an oppositely directed force as slide 20 moves toward its lowermost position. As slide 20 begins its return stroke, the air cushion 40 begins to return to its top stroke position. Slide 20 and air cushion 40 travel together to a point just before the point where upper die 24 no longer contacts lower die 30. The snubber apparatus begins to snub the motion of air cushion 40 at that point and continues the snubbing action until the air cushion 40 has returned to its top stroke position. During this sequence when air cushion 40 is depressed, the air cushion 40 serves to provide blank holding for drawing metals within forming press 10 or acts to eject the formed parts out of lower dies 30 as slide 20 continues its upward motion after the dies 24 and 30 separate.

FIG. 2 illustrates the air cushion 40 having the preferred embodiment of the snubber apparatus forming the present invention therein. The exterior portions of air cushion 40 are comprised of lower cylindrical body 42 and upper cylindrical body 44. The lower cylindrical body comprises several cylindrical sections separated by cylinder heads described hereinafter and is secured at its lower end to the bed 12 of press 10 by bolts 46 and other bolts (not shown). The upper cylindrical body 44 has an internal diameter sufficiently large so that it may be fit over the outer periphery of the upper portion of lower cylindrical body 42. Seal 49 is disposed between the inner periphery of upper cylindrical body 44 and the outer periphery of lower cylindrical body 42 to define a sealed air space within the interiors of bodies 42 and 44. Upper cylindrical body 44 has a pin impact surface 50 thereon which contacts the lower end of bolster pins 36 and 38. The pin impact surface 50 is typically designed to be replaced with ease as it is subject to wear by the action of the bolster pins 36 and 38.

Rigidly mounted to the interior end portion of upper cylindrical body 44 is a hollow piston shaft 52 which provides a passageway for pressurized air as hereinafter described. Piston shaft 52 is aligned with the central vertical axis of both bodies 42 and 44. The piston shaft 52 illustrated in FIG. 2 has two piston heads 54 and 56 distributed along its length in sealing engagement with the inner periphery of lower cylindrical body 42 by means of seals 55 and 57. Lower cylindrical body 42 in turn is equipped with a top cylinder head 58 and bottom cylinder head 60 in sealing engagement with the outer circumference of the piston shaft 52 by means of seals 59 and 61. A floating piston 62 is provided between bottom cylinder head 60 and piston head 56 and sealed to the inner periphery of lower cylindrical body 42 and the outer circumference of piston shaft 52 by means of seals 63.

It is clear from FIG. 2 that the various components of air cushion 40 serves to define cushion chambers 64, 66 and 68 and snubbing chamber 70. Air passage 72 within piston shaft 52 serves to maintain the air pressure within the cushion chamber 64, 66 and 68 at a uniform level through air inlets 74 communicating between the air passage 72 and the cushion chambers. The air pressure in the cushion chambers 64, 66 and 68 is determined by the pressure supplied to the pressure port 76 formed at the bottom of lower cylindrical body 42 and communicating with a source of compressed air.

The pressure in the cushion chambers 64, 66 and 68 may range from 10 psi to as high as 200 psi. As the air cushion is depressed by means of the pins 32, 34, 36 and 38, air is forced back into an expansion tank (not shown) to prevent an excessive increase in cushion chamber air pressure. The cushion maintains a constant force directed against the pins, which in turn directs a force against upper die 24 or against the work piece if the pins are in direct contact. It is also clear that the upward stroke of the air cushion returning to its top stroke position travels at the same velocity as the press slide 20 and has sufficient force to eject the work piece if so desired.

The air cushion 40 illustrated in FIG. 2 is termed a three-inch stack. In other words, the air cylinder 40 has three separate cushion chambers 64, 66 and 68. Cushions made up of a single cylinder, 2, 3 and 4 high stacks are commonly employed in the forming press art. Air cushions may be mounted on either the bed or the press slide. However, the most common location is as shown in FIG. 2 in the press bed. The stroke length of an air cushion is normally designed to be less than half the stroke of slide 20. However, in rare cases, an air cushion stroke may exceed one half of the stroke of slide 20.

An air cushion 40 is commonly equipped with a snubber system or apparatus which rapidly decelerates or snubs the motion of the air cushion 40 as it nears its top stroke position as slide 20 moves upwardly. Deceleration of air cushion 40 without any form of snubbing can be as high as 350 g's. Thus, the snubber system prevents damage to the air cushion from the violent impact of the air cushion into its top stroke position that would otherwise occur. It is desirable to decelerate the air cushion 40 as quickly as possible with a minimum amount of impact. The snubber system commonly employed in the forming press art includes a snubbing chamber, which is fitted with a small orifice, for compressing air at atmospheric pressure during the last portion of travel of the air cushion before it reaches the top stroke position. The compressed air in the snubbing chamber must substantially exceed the pressure in the cushion chambers for a sufficient period of time to snub the motion of the air cushion. In order for the snubbing chamber to function adequately, the orifice must be small enough to prevent the air from escaping while it is being compressed during the last portion of the upward motion of the air cushion to its top stroke position. It is clear that as the pressure within the cushion chambers of an air cushion varies, or the number of cushion chambers vary, the time interval necessary for snubbing an air cushion by the known method varies over a broad range. Since many presses are equipped with automatic parts feeding devicees that are precisely sequenced to position work pieces for forming and removing the formed work pieces thereafter, the need for a uniform and swift snubbing time interval is clear.

The snubber apparatus forming the present invention is designed to permit snubbing of an air cushion within a controlled time period with a minimal variation in the snubbing time as a result of variations in cushion air pressure and cushion return velocities. The snubber apparatus of the present invention further has an advantage in that it may be adapted for use with an an air cushion with any number of stacks. Also, many elements of the apparatus are arranged to be removable from the air cushion without disassembling the cushion itself, therefy simplifying service and maintenance.

Figure 3:
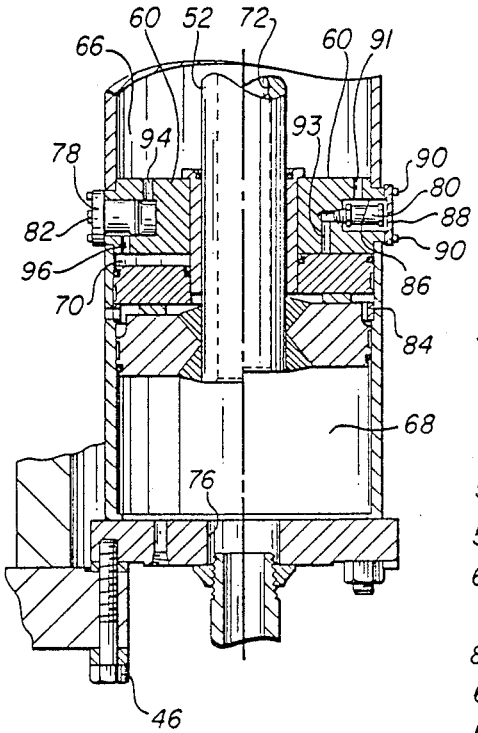
FIG. 3 is a vertical cross-sectional side view of a portion of the air cushion showing the air cushion in two positions, the first being in a partially compressed state wherein the cushion chamber piston has just contacted the floating snubbing chamber piston, and with the second being the air cushion in its top stroke position.
Figure 6A:
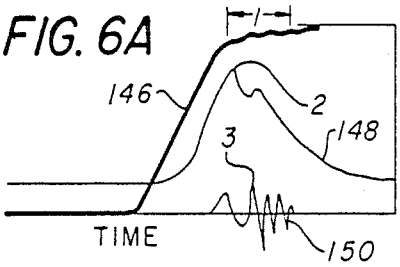
FIGS. 6A, 6B, 6C, 6D and 6E illustrate graphically the performance of the snubber apparatus of the present invention at a given contact velocity for variation in cushion chamber pressure.
Figure 6B:
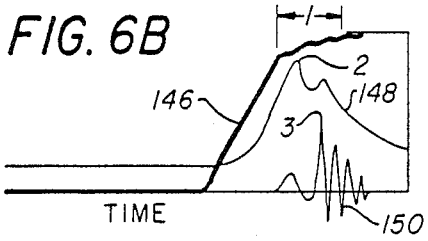
Figure 6C:
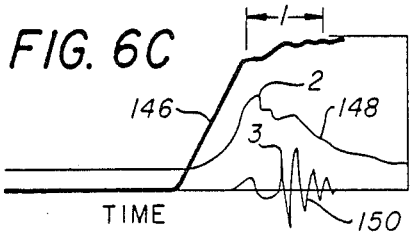
Figure 6D:
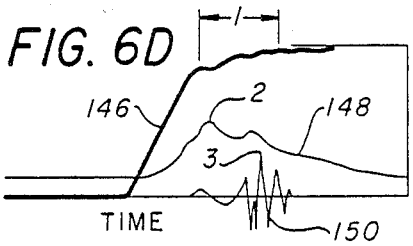
Figure 6E:
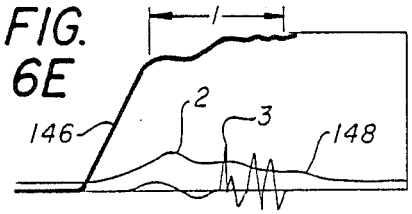

The snubber apparatus of the present invention is best illustrated in FIGS. 2–4. The apparatus comprises generally a snubber valve 78, check valve 80, floating piston 62 and an orifice plug 82. In FIG. 2, air cushion 40 is shown in the fully compressed position with cushion chamber 68 at its minimum volume. In the fully compressed state, floating piston 62 rests on piston stops 84 extending from the inner periphery of the lower cylindrical body 42. In this position, the volume of the snubbing chamber 70 is maximum.

Check valve 80 is positioned within a fitted chamber 86 in bottom cylinder head 60 as shown. The fitted chamber 86 is sealed from the outside environment by an inspection plate 88 secured to bottom cylinder head 60 by bolts 90. The inspection plate 88 permits rapid access to the check valve 80 for service and maintenance and does not require any other disassembly of the air cushion. The fitted chamber 86 communicates with cushion chamber 66 and snubbing chamber 70 by means of ports 91 and 93, respectively. The check valve 80 is positioned so that air will pass through the valve and into the snubbing chamber 70 if the pressure in snubbing chamber 70 drops below the pressure of cushion chamber 66.

The structure of snubber valve 78 and orifice plug 82 are best illustrated in FIG. 4. A fitted chamber 92 is provided in bottom cylinder head 60. The chamber 92 communicates with cushion chamber 66 and snubbing chamber 70 through ports 94 and 96, respectively. A sleeve housing 98 is inserted into chamber 92 and is secured to the bottom cylinder head 60 by bolts 100. Seal grooves 102 and 104 are provided on the outer surface of sleeve housing 98 that receive O rings 106 and 108 to seal the sleeve housing 98 to the outer surface of the bottom cylinder head 60 and inner surface of fitted chamber 92, respectively. A valve spool 110 is slidably mounted within sleeve housing 98 as shown. The valve spool 110 is circular in cross-section and is formed with a hollow core 112 as shown to receive a spring member 113 disposed between the inner end of spool 110 and the inner wall of chamber 92. The valve spool 110 defines five separate regions along its length. The first region A is formed into a seal surface 114 by the continual increase in the external diameter of valve spool 110 in region A. The external diameter of valve spool 110 is uniform in region B. A gap is defined between the inner surface of sleeve housing 98 and the outer surface of valve spool 110. This gap is in communication with port 96 through port 116 defined in sleeve housing 98. Region C is formed with an external diameter substantially the same as the inner diameter of the adjacent portion of sleeve housing 98. A sealing groove 118 is provided about the outer periphery of the valve spool 110 in region C and receives an O ring 120 to form a seal between housing 98 and spool 110. Region D comprises an external diameter equivalent to the external diameter in region C for a portion of its length, but gradually increases to the larger external diameter of region E as discussed hereinafter. A void is thereby defined between the outer surface of spool 110 and the inner surface of housing 98 in region D. As discussed above, in region E the external diameter of spool 110 is further enlarged. The inner diameter of housing 98 near region E is also larger to correspond substantially to the external diameter of spool 110. A sealing groove 122 is provided on the outer perimeter of spool 110 for receiving O ring 124 to create a seal between housing 98 and spool 110 in region E. Port 126 is formed in spool 110 permitting communication with port 94.

A valve seat 128 is positioned at the outer end of housing 98 and secured to housing 98 by bolts 130. A sealing groove 132 is provided in the outer periphery of valve seat 138 for receiving an O ring 134 to seal between seat 128 and housing 98. The edge 136 of valve seat 128 is formed to engage seal surface 114 of spool 110 and form an airtight seal therebetween. A through passage is provided in valve seat 128 and is defined by a chamber 138 and portion 140 removably receiving orifice plug 82 having a drilled orifice hole 142 with a predetermined diameter therein. A port 144 is provided through valve seat 128 and housing 98 for communication between the void between the housing 98 and spool 110 at region D and the outside atmosphere. Certain bolts 100 and 130 may be offset to ensure proper placement of housing 98 and valve seat 128.

The spool 110 may slide within sleeve housing 98 along its center axis from the position as shown in FIG. 4 with seal surface 114 abutting edge 136, to a position where the end of spool 110 abuts the inner wall of chamber 92. If the total force acting on spool 110 from cushion chamber 66 and spring member 113 exceeds the total force exerted by the air pressure in the snubbing chamber 70, the sealing surface 114 of valve spool 110 will be urged into sealing relationship with edge 136 of valve seat 128. In that position, valve 78 is closed and the snubbing chamber 70 cannot communicate with the outside atmosphere. However, if the total force exerted by the air pressure from the snubbing chamber 70 exceeds the total force exerted by the cushion chamber 66 and spring member 113, the seal surface 114 will move out of engagement with edge 136 of valve seat 138 and air from the snubbing chamber 70 will escape into chamber 138 and into the orifice hole 142 to the outside atmosphere.

The total force exerted by the air pressure from snubbing chamber 70 urging the spool 110 to slide along its center axis is determined by the air pressure in chamber 70 and the effective cross-sectional area of spool 110 in region C exposed to that pressure. The effective cross-sectional area lies in a plane perpendicular to the center axis. The effective cross-sectional area exposed to the air pressure in snubbing chamber 70 when the valve 78 is closed is the net cross-sectional area determined by subtracting the cross-sectional area of spool 110 at the point of sealing against edge 136 from that in region C. After valve 78 opens, the air pressure in snubbing chamber 70 acts on an effective area equivalent to the cross-sectional area of spool 110 in region C, although the air pressure is greatly reduced by flow to the atmosphere.

The force acting on spool 110 from the air pressure in cushion chamber 66 is determined by the air pressure in chamber 66 and the cross-sectional area of spool 110 determined by the external diameter of the spool 110 in region E.

When the air cushion 40 is in the compressed state as shown in FIG. 2, check valve 80 maintains the snubbing chamber 70 at an air pressure equivalent to that found in cushion chamber 66. As a result of the different cross-sectional areas in region C and region E of spool 110 and spring member 113, seal surface 114 is urged into sealing engagement with edge 136, although the air pressure in both cushion chambers 66 and snubbing chamber 70 is equivalent.

As outer cylinder 44 begins to move toward its top stroke position, piston head 56 will impact against floating piston 62 as shown in the left half of FIG. 3. As the air cylinder 40 continues its motion of its top stroke position as shown in the right half of FIG. 3, the air in snubbing chamber 70 is compressed very rapidly as a result of the extreme change in the ratio of the volume of snubbing chamber 70 as the floating piston moves from its lower position against stops 84 to its position abutting bottom cylinder head 60 when air cushion 40 is in its top stroke position. The compression of the air within snubbing chamber 70 is sufficient to cushion or snub the motion of the air cushion 40 near its top stroke position. As the minimum pressure in snubbing chamber 70 is equivalent to the pressure provided in cushion chambers 64, 66, and 68, the total force exerted in the snubbing chamber 70 to snub the motion of the air cushion 40 is greatly increased over the force that would be provided were the minimum pressure in snubbing chamber 70 to be at atmospheric pressure.

As the floating piston 62 moves from the position shown in the left half of FIG. 3 to that shown in the right half of FIG. 3, the snubbing chamber pressure increases rapidly and far exceeds the cushion chamber pressure, thereby snubbing the motion of the air cushion 40 and preventing a violent impact when air cushion 40 returns to its top stroke position. At some point, after substantially all the snubbing action has been completed, the snubbing chamber pressure reaches sufficient magnitude to move seal surface 114 of spool 110 out of engagement with edge 136 of valve seat 128. That motion permits the air within the snubbing chamber 70 to move into chamber 138 and through orifice hole 142 to the atmosphere. It is clear that, after the opening of a flowpath between the snubbing chamber 70 and the atmosphere, the force exerted to snub the motion of the air cushion 40 within snubbing chamber 70 is substantially alleviated. The size of orifice hole 142 may be varied to provide the desired amount of alleviation as the compressed air within the snubbing chamber 70 is metered to the atmosphere through the orifice hole 142. It is clear that, unless the snubbing chamber pressure reaches sufficient magnitude to move seal surface 114 of spool 110 out of engagement with edge 136 of valve seat 128, the snubber valve 78 is biased in the closed position to prevent air flow through the valve to minimize the loss of compressed air as when the air cushion 40 is in a static or nonmoving state at any position during the travel of the air cushion 40.

A substantial advantage of the present invention is that the snubber apparatus may be adapted for use with air cushions of 1, 2, 3, 4 or more high stacks. The ratio of cross-sectional area of spool 110 in regions C and E may be varied to compensate for the change in numbers of chambers in a stack although the ratio remains fixed for a given number of stacks. As more chambers are used, the snubbing chamber 70 must reach higher pressure levels to overcome the greater forces created by the additional cushion chambers.

The total stroke of the floating piston 62 also varies with the number of chambers in a stack. As an example, the stroke range may vary from 0.375 inches to 0.75 inches from a one to a four chamber stack. Before deceleration or cushioning will occur, the air in the snubbing chamber 70 must be sufficiently compressed to create a snubbing force in excess of the cushion force. The snubber valve is designed to permit the snubbing chamber to achieve the necessary pressure and substantially snub the motion of the cushion before the valve opens. The design of the snubber valve 78 also has the advantage of being readily accessible from outside the air cushion 40 for maintenance and repair. Bed 12 has ports 143 and 145 therein to permit access to snubber valve 78 and check valve 80.

The present invention forms a substantial improvement over the prior art in permitting control of the time necessary for the last increment of cushion travel prior to reaching the top cushion position. As discussed hereinabove, the prior art has used systems trapping and compressing air at atmospheric pressure within a chamber fitted with a small orifice. Since air at atmospheric pressure was used, the compression ratio to equalize the cushion force to snub the air cushion is much higher than is necessary in the present invention. The necessity of this large compression ratio required the orifice to be of quite small size and therefore the time needed for the last increment of cushion travel after the majority of the snubbing action was completed was unnecessarily long and depended very greatly upon the cushion chamber pressures and the cushion return velocity. In the present invention, the air within the snubbing chamber 70 is compressed within a sealed area while the snubber valve 78 is closed. The minimum air pressure in snubbing chamber 70 is automatically maintained equivalent to the air pressure in the cushion chamber. This permits a larger snubbing pressure to be generated than is possible in the prior known art. In addition, at a given air pressure within snubbing chamber 70, the snubber valve 78 opens and permits the air within the snubbing chamber 70 to escape to the atmosphere. It is possible to use a much larger orifice in the orifice plug 82 than could be employed in the prior art, thus decreasing the time necessary for the last increment of cushion travel before cushion 40 reaches the top stroke position. It is clear that the orifice plug 82 may be easily changed to accomodate different cushion velocity ranges during the operation of the forming press. The present invention thereby forms a substantial improvement in the operation of forming presses equipped with automatic parts feeding devices that are precisely sequenced and depend on the work plate being lifted out of the die at a precise moment in time.

Figure 5A:
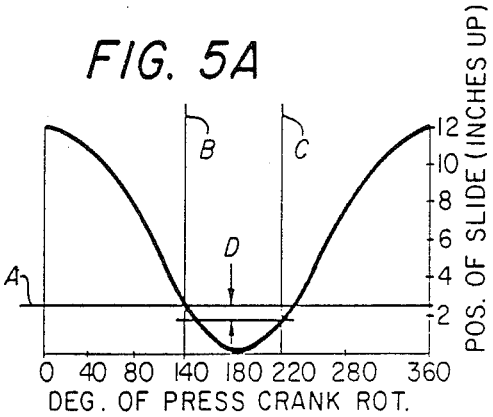
FIGS. 5A and 5B illustrate graphically the operation of the forming press.
Figure 5B:
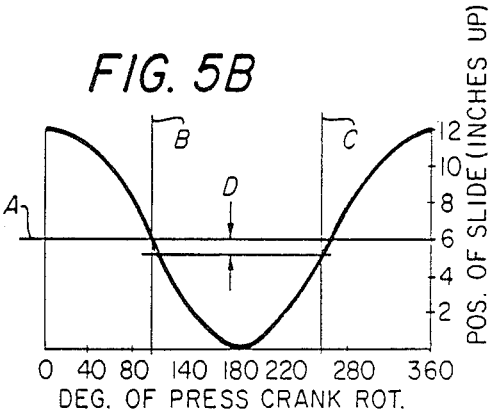

FIGS. 5A and 5B illustrate the interaction between slide 20 and air cushion 40. Both FIGS. 5A and 5B have a horizontal axis corresponding to one complete cycle of slide 20 from a position of 0 degrees of press crank rotation through an entire 360 degree cycle of the press crank, returning to the point of origin at the right side of the FIGURE. The vertical axis represents the position of slide 20 relative to the lowest point reached during its cyclical motion.

In FIG. 5A, horizontal line A represents the position of the upper portions of die pins 32 and 34 when air cushion 40 is in its top stroke position. The point of intersection of horizontal line A and vertical line B represents the point at which contact is made between the upper die 24 and the die pins 32 and 34. The air cushion 40 is then compressed to a total distance of approximately 2½ inches as slide 20 reaches its lowermost position at a degree of press crank rotation of 180 degrees. As the slide 20 begins its upward motion, the air cushion 40 begins to move back toward its top stroke position. Vertical line C represents the degree of press crank rotation at which piston head 56 first contacts floating piston 62. The distance D represents the total stroke of the floating piston 62, being three quarters of an inch in both FIGS. 5A and 5B. The snubbing action of the snubber apparatus forming the present invention begins at the degree of press crank rotation determined by vertical line C. Although the motion of slide 20 is a continuous, sinusoidal curve, the snubber apparatus snubs the motion of air cushion 40 so that it reaches its top stroke position after slide 20 has moved upward from the top stroke position represented by horizontal line A. In the graph of 5A, the slide velocity at the point of contact between the slide and cushion is 90 feet per minute.

FIG. 5B differs from FIG. 5A only in the respect that the slide 20 impacts on the die pins 32 and 34 earlier in the rotation of the press crank. Clearly, this requires the air cushion 40 to be depressed a greater distance. In the example of FIG. 5B, the air cushion is depressed a total distance of approximately size inches at the lowest point of the motion of slide 20. As in FIG. 5A, the point at which the piston head 56 impacts the floating piston 62 is represented by vertical line C. As in FIG. 5A, the stroke of the floating piston 62 is three-quarters of an inch as represented by the distance D. The slide velocity of slide 20 at the point of impact between the slide and the die pins in FIG. 5B is 110 feet per minute. In both FIGS. 5A and 5B the maximum cushion capacity is 57.3 tons at 100 psi. The forming press was operated at a rate of 35 strokes per minute.

FIGS. 6A–6E illustrate the operation of the snubbing apparatus of FIG. 5A for five different values of cushion chamber pressures. The abscissa of the graphs represent the time interval from the point of maximum compression of the air cushion to the point the air cushion reaches the top stroke position. Curve 146 illustrates the position of the air cushion varying from the maximum compression position to the top stroke position represented by the upper horizontal lines. The snubber apparatus is effective during the snub time interval 1 as marked on the graphs. It can be easily seen that the motion of the air cushion is snubbed and deaccelerated at a much less severe rate due to the action of the snubber apparatus. Curve 148 illustrates the pressure within snubbing chamber 70. Before the snubber apparatus snubs the motion of the air cushion, the pressure within the snubbing chamber is equivalent to the cushion chamber pressure. As can be observed in the graphs, the pressure within the snubbing chamber rapidly increases to a p-max value at which point the snubber valve 78 is opened and the air escapes from the snubber chamber to the outside atmosphere and the pressure within the snubbing chamber decreases rapidly. Curve 150 illustrates the rate of deceleration of the air cushion as it approaches the top stroke position. A tabulation of the Snub Time, P-Max, and Deceleration rate for the graphs illustrated in FIGS. 6A–6E are provided below in sequential order, starting with the cushion chamber pressure at 100 psi in FIG. 6A. Snub Time is the time required for the cushion to reach the top stroke position after the snubber apparatus becomes active.

P-Max is the maximum pressure attained in the snubbing chamber.

Deceleration rate is the maximum deceleration of the cushion during the snubbing action of the snubber apparatus.

| CUSHION CHAMBER PRESSURE (PSI) | SNUB TIME (SEC) | P-MAX (PSI) | DECELERATION RATE (g = 32 ft/sec$^2$) |
|---|---|---|---|
| 100 | .025 | 430 | 6.6 |
| 80 | .03 | 380 | 6.6 |
| 60 | .04 | 278 | 5.2 |
| 40 | .05 | 193 | 5.2 |
| 20 | .08 | 113 | 4.7 |

The values tabulated above are for the forming press represented in FIG. 5A with a slide contact velocity of 90 feet per minute. A similar chart listing the values of Snub Time, P-Max and Deceleration rate for the press of FIG. 5B with a contact velocity of 110 feet per minute is provided below:

| CUSHION CHAMBER PRESSURE (PSI) | SNUB TIME (SEC) | P-MAX (PSI) | DECELERATION RATE (g = 32 ft/sec$^2$) |
|---|---|---|---|
| 100 | .04 | 443 | 9.0 |
| 80 | .04 | 386 | 9.0 |
| 60 | .045 | 312 | 9.0 |
| 40 | .055 | 221 | 8.5 |
| 20 | .08 | 130 | 7.1 |

Although one particular embodiment of the present invention has been described in the foregoing Detailed Description, it will be understood that the invention is not limited to the embodiment disclosed, but is capable of numerous rearrangements, modifications, and substitutions of parts and elements without departing from the spirit of the invention.

We claim:

1. A snubber apparatus for snubbing the motion of a member in a press, the member operating with a compressible material at a first variable pressure and having a range of motion between first and second positions, comprising:

means forming a snubbing chamber having a volume variable in response to the motion of the member within a predetermined range of motion from the first position to a disengagement position to establish a constant maximum snubbing chamber volume, said snubbing chamber volume being independent of the motion of the member as the member moves from the disengagement position to the second position;

check valve means for permitting compressible material from the member at the first variable pressure to flow into the snubbing chamber when the first variable pressure exceeds the pressure in the snubbing chamber, the pressure differential between the snubbing chamber and the member and the flow of compressible material therebetween causing expansion of the snubbing chamber;

snubber valve means communicating with said snubbing chamber for releasing compressible material from the snubbing chamber to a relatively low pressure reservoir;

means biasing said snubber valve means in a closed position to prevent flow of the compressible material therethrough; and the compressible material within said snubbing chamber snubbing the motion of the member as said snubbing chamber volume decreases, said snubber valve means opening when the compressible material reaches a second predetermined pressure to permit flow of the compressible material through said snubber valve means to the low pressure reservoir and thereby alleviate snubbing of the member, the check valve means supplying compressible material at the first variable pressure to the snubbing chamber to replace the compressible material flowing through said snubber valve means, the maintenance of the compressible material at at least the first variable pressure within the snubbing chamber causing the snubbing action to be relatively independent of the first variable pressure within a range of pressure.

2. The snubber apparatus of claim 1 wherein said snubber valve means comprises:

means forming a valve chamber communicating with said snubbing chamber and the relatively low pressure reservoir;

a removable valve seat formed within said valve chamber and surrounding an orifice of predetermined dimensions;

a valve spool having a conical seal surface thereon mounted within said valve chamber for motion from a first position to a second position, said valve spool communicating with the first variable pressure of the member and the pressure within the snubbing chamber such that said valve spool remains in said first position until the pressure in said snubbing chamber exceeds the first variable pressure; and said seal surface sealing against said valve seat to close the snubber valve means and prevent flow of the compressible material through the orifice when said valve spool is in the first position, said seal surface being separated from said valve seat to open the snubber valve means and permit flow of the compressible material through the orifice in said snubber valve means from said snubbing chamber to the low pressure reservoir when said valve spool is in the second position, said conical seal surface adapted for sealing against a range of valve seat dimensions to permit variations of the orifice dimensions through the valve seat.

3. The snubber apparatus of claim 1 wherein said snubber valve means further comprises orifice means for controlling the flow of the compressible material through said snubber valve means upon opening of said snubber valve means.

4. The snubber apparatus of claim 1 wherein the member comprises a cushion assembly having at least one cushion chamber with compressible material therein at the first variable pressure allowing said cushion assembly to yieldably deform and cushion a second member in the forming press.

5. The snubber apparatus of claim 4 wherein the predetermined pressure opening said snubber valve means is varied in response to the number of cushion chambers in said cushion assembly.

6. The snubber apparatus of claim 1 wherein the volume of said snubbing chamber is decreased as the member moves toward the end of its motion to decelerate the member, said snubber valve means opening to shorten the time necessary for the last increment of travel as the member approaches the end of its motion.

7. The snubber apparatus of claim 6 wherein said snubber valve means further defines an orifice for controlling the flow of the compressible material upon the opening of said snubber valve means to adapt the snubber apparatus for use with a range of cushion assembly velocities and cushion chamber compressible material pressures.

8. A snubber apparatus for snubbing the motion of a cushion assembly yieldably deforming to cushion a member in a press, the cushion assembly including at least one cushion chamber with compressed air therein at a first predetermined pressure variable within a range of pressures and having a range of motion between first and second positions, comprising:

means for forming a snubbing chamber for filling with air and having a volume variable in response to the deformation of said cushion assembly within a predetermined range of motion from the first position to a disengagement position to establish a constant maximum snubbing chamber volume that remains at a constant volume as the cushion chamber moves from the disengagement position to the second position, the range of motion of said snubbing chamber independent from the range of motion of said cushion assembly such that a variance between the disengagement and second positions does not affect the maximum volume of said snubbing chamber;

snubber valve means communicating with said snubbing chamber;

means biasing said snubber valve means in a closed position to prevent air flow therethrough;

a check valve connected between said cushion chamber and said snubbing chamber to permit flow of air thereto when the air pressure in said cushion chamber exceeds the air pressure in said snubbing chamber, the flow of air therebetween causing said snubbing chamber to expand; and the air within said snubbing chamber snubbing the motion of the cushion assembly as the volume of said snubbing chamber decreases as the cushion chamber moves through said disengagement position to said first position, the air in said snubbing chamber further opening said snubber valve means at a second, higher predetermined pressure to permit flow of the air through said snubber valve means to alleviate the snubbing of the cushion assembly, said first predetermined pressure exceeding atmospheric pressure, the maintenance of the air within the snubbing chamber at at least the first predetermined pressure permitting the snubbing action to be relatively independent of the first predetermined pressure within the range of pressures to achieve the snubbing action over a relatively constant travel of the cushion assembly and time interval independent of the first predetermined pressure within the range of pressures.

9. The snubber apparatus of claim 8 wherein said means biasing said snubber valve means in a closed position comprises air from the cushion chamber at the first predetermined pressure.

10. The snubber apparatus of claim 8 wherein said snubber valve means comprises:

a member forming a valve chamber communicating with said snubbing chamber, the cushion chamber and the atmosphere;

a spring disposed in said valve chamber;

a removable valve seat secured to said valve chamber and surrounding an orifice or predetermined dimensions; and a valve spool slideably mounted within said valve chamber and against said spring, said valve spool having a conical seal surface, for movement from a first position with said conical seal surface engaging said valve seat and closing said snubber valve means to a second position opening said snubber valve means to permit air flow from said snubbing chamber to the atmosphere through the orifice, said conical seal surface adapted for sealing against a range of valve seat dimensions to permit variation of the orifice dimensions through the valve seat, the orifice dimensions being determined by the quantity of cushion chamber within the snubber apparatus, said spool urging said conical seal surface against said valve seat in response to the compressive force of said spring and the pressure in the cushion chamber, said spool unsealing said conical seal surface in response to the pressure in said snubbing chamber exceeding the sum of the spring force and hydraulic force due to the pressure in the cushion chamber.

11. The snubber apparatus of claim 8 wherein said snubber valve means further defines an orifice for controlling the airflow upon opening of said snubber valve means to adapt the snubber apparatus for use with a range of cushion assembly velocities.

12. The snubber apparatus of claim 8 wherein the second, higher predetermined pressure is determined by the number of cushion chambers in the cushion assembly such that the force exerted by air within said cushion chambers inducing motion in the cushion assembly is exceeded by the force exerted by the air in said snubbing chamber to snub the motion of the cushion assembly.

13. The snubber apparatus of claim 8 wherein the volume of said snubbing chamber decreases as the cushion assembly moves toward a top stroke position to snub the motion of the cushion assembly as it approaches the top stroke position, said snubber valve means opening to decrease the time interval for the last portion of motion before the cushion assembly reaches the top stroke position.

14. The snubber apparatus of claim 8 wherein said snubber valve means comprises:

a valve spool slideably mounted within a valve chamber formed within the cushion assembly for movement from a first position to a second position, said valve spool defining a conical sealing surface thereon, said valve chamber communicating with the atmosphere, said snubbing chamber and said cushion chamber;

a removable valve seat cooperating with the seal surface on said valve spool to close the snubber valve means when said valve spool is in the first position and open said snubber valve means when said valve spool is in the second position;

a spring disposed in said valve chamber diametrically opposite said valve seat; and the air pressure in the cushion chamber and said spring urging said valve spool to the first position and the air pressure in said snubbing chamber urging the valve spool towards the second position when the air pressure in said snubbing chamber exceeds the sum of the compressive force due to said spring and the hydraulic force resulting from the pressure in said cushion chamber, the conical seal surface being adapted for sealing engagement with a valve seat within a range of dimensions to permit selection of a desired ratio of area exposed to the cushion chamber pressure and area exposed to the snubbing chamber pressure determined by the number of cushion chambers in the cushion assembly.

15. A snubber apparatus for snubbing the motion of a cushion assembly yieldably deforming to cushion a member in a press, the cushion assembly including at least one cushion chamber with compressed air therein at a first predetermined pressure variable within a range of pressures, comprising:

means for forming a snubbing chamber for filling with air and having a volume variable in response to the deformation of said cushion assembly;

snubber valve means communicating with said snubbing chamber;

means biasing said snubber valve means in a closed position to prevent airflow therethrough;

a check valve connected between said cushion chamber and said snubbing chamber to permit flow of air thereto when the air pressure in said cushion chamber exceeds the air pressure in said snubbing chamber;

the air within said snubbing chamber snubbing the motion of the cushion assembly as the volume of said snubbing chamber decreases, the air in said snubbing chamber further opening said snubber valve means at a second, higher peredetermined pressure to permit flow of the air through said snubber valve means to alleviate the snubbing of the cushion assembly, the maintenance of the air within the snubbing chamber at at least the first predetermined pressure permitting the snubbing action to be relatively independent of the first predetermined pressure within the range of pressures to achieve the snubbing action over a relatively constant travel of the cushion assembly and time interval independent of the first predetermined pressure within the range of pressures;

said cushion assembly including:

(a) a first body secured to the forming press;

(b) a second body cooperating with said first body to form at least one cushion chamber therebetween and moving relative to said first body to permit the deformation of the cushion assembly;

(c) a floating piston positioned within said first body for motion relative to said first and second bodies, said piston and said first body forming said snubbing chamber therebetween;

(d) stop means for limiting the motion of said floating piston to limit the maximum volume of the snubbing chamber; and (e) said second body contacting said floating piston to decrease the volume of said snubbing chamber during the deformation of the cushion assembly, said stop means limiting the volume of the snubbing chamber so that the snubbing action is relatively independent of the stroke length of the cushion assembly and to minimize the discharge of air through said snubber valve means to alleviate the snubbing of the cushion assembly.

16. An air cushion assembly having a snubber apparatus therein, said cushion assembly yieldably deforming to cushion a member in a forming press and comrising:

a first body;

a second body for motion relative to said first body;

a piston shaft secured to said second body and extending into said first body;

at least one piston head means attached along the length of said piston shaft and within said first body;

at least one cylinder head means attached within said first body;

said first body, said second body, said piston shaft, said piston head means and said cylinder head means defining a plurality of cushion chambers, said cushion chambers being variable in volume and having compressed air at a first variable predetermined pressure within a range of pressures therein to permit the cushion assembly to yieldably deform;

floating piston means positioned between said cylinder head means and said piston head means and defining a snubbing chamber between said floating piston means, said first body and said cylinder head means;

stop means for limiting the motion of said floating piston means to limit the maximum volume of said snubbing chamber, said stop means permitting said piston head means to move a portion of its travel disengaged from said floating piston means so that pressurized air in said snubbing chamber does not affect the cushion action of the cushion assembly when disengaged;

snubber valve means for permitting airflow therethough having an inlet communicating with said snubbing chamber and an exhaust communicating with the atmosphere;

the air in at least one of said cushion chambers biasing said snubber valve means in a closed position preventing flow of air therethrough;

said snubber valve means further defining an orifice of predetermined dimension in the exhaust of said snubber valve means for communication with the atmosphere to control the flow of air therethrough, the dimension of said orifice being variable to adjust the snubber apparatus for use with a range of cushion chamber air pressures and cushion assembly velocities;

a check valve communicating with said snubbing chamber and at least one of said cushion chambers, said check valve permitting air to flow therethrough when the air pressure within said snubbing chamber decreases below the first predetermined pressure;

said piston head means contacting said floating piston means as the cushion assembly returns to the undeformed state and causing the air within the snubbing chamber to be compressed to snub the motion of the cushion assembly; and the air within said snubbing chamber opening said snubber valve means at a second, higher predetermined pressure to permit flow of the air through said snubber valve means and said orifice to alleviate the snubbing of said cushion assembly, said snubber valve means closing after the pressure in said snubbing chamber is insufficient to counteract the air pressure in said cushion chamber biasing said snubber valve means in the closed position, the presence of air in said snubbing chamber at at least the first predetermined pressure retaining the compression ratio of the air within said snubbing chamber to snub the cushion assembly substantially constant over the range of the first predetermined pressure to snub the motion of the cushion assembly over a relatively constant time duration and stroke length over the range of the first predetermined pressure, the limitation of volume in said snubbing chamber by said stop means permitting the snubbing action to be performed independently of the stroke length of the cushion assembly and minimize the flow of air through said snubber valve means to alleviate the snubbing action to render the duration of the snubbing action relatively independent of stroke length and the first predetermined pressure and minimize the heat of compression of the air within said snubbing chamber during the snubbing action.

17. The snubber apparatus of claim 16 wherein said snubber valve means further comprises:

a sleeve;

a valve seat;

a valve spool slidably positioned within said sleeve and having a first portion communicating with the air in at least one of said cushion chambers, a second portion communicating with the air in said snubbing chamber and a third portion for sealing against an edge of said valve seat to close said snubber valve means;

the air acting on said first portion exerting a force biasing said third portion against the edge of said valve seat and the air acting on said second portion exerting a force urging the third portion away from the edge of said valve seat, said first portion being relatively larger than said second portion to maintain said third portion sealed against the edge of said valve seat when the air pressure in said snubbing chamber and said cushion chamber is equal.

18. The snubber apparatus of claim 17 wherein the ratio of the area of said first portion to said second portion is determined by the number of cushion chambers in the cushion assembly.

19. The snubber apparatus of claim 16 wherein said second predetermined pressure is determined by the number of cushion chambers in the cushion assembly.

20. The snubber apparatus of claim 16 wherein said snubber valve means and said check valve are positioned within said cylinder head means adjacent to said floating piston means so that said snubber valve means and said check valve may be removed from the cushion assembly without further disassembling the cushion assembly.

21. An improved snubber apparatus for a cushion assembly yieldably deforming to cushion a member in a forming press, the cushion assembly adapted for having a snubber apparatus with a snubbing chamber and means for supplying the snubbing chamber with atmospheric pressure air, said cushion assembly comprising:

a first body rigidly secured to said forming press;

a second body for motion relative to said first body and contacting said member;

a piston shaft having a passage therein secured to said second body and extending into said first body;

at least one piston head secured along the length of said piston shaft and within said first body;

seal means disposed between said piston head and said first body;

at least one cylinder head secured within said first body;

seal means disposed between said cylinder head and said piston shaft;

said first and second bodies, said piston shaft and said piston and cylinder heads defining a plurality of cushion chambers, said cushion chambers being variable in volume and having compressed air therein permitting said cushion assembly to yieldably deform, said passage within said piston shaft communicating between said plurality of cushion chambers for maintaining the air within said cushion chambers at an equivalent pressure;

said improved snubber apparatus comprising:

a floating piston positioned between one of said cylinder heads and one of said piston heads;

stop means for limiting the motion of said floating piston from said one of said cylinder heads;

first seal means disposed between said floating piston and said first body;

second seal means disposed between said floating piston and said piston shaft;

said floating piston, said cylinder head, said first and second seal means and said first body defining a snubbing chamber for filling with compressed air and having a volume variable in response to the motion of said floating piston, said stop means limiting the maximum volume of the snubbing chamber;

a snubber valve means disposed within said one of said cylinder heads adjacent said floating piston, said snubber valve means communicating with said snubbing chamber;

the air in at least one of said cushion chambers biasing said snubber valve means in a closed position preventing air in said snubbing chamber from flowing therethrough;

means defining an orifice removably secured to said snubber valve means for communicating with the atmosphere;

a check valve communicating with at least one of said cushion chambers and said snubbing chamber to maintain the pressure in the snubbing chamber at least equal to the pressure in the cushion chambers;

said one of said piston heads adjacent said floating piston contacting said floating piston during the upstroke of the cushion assembly after yieldably deforming to cushion a member in the forming press, the further motion of said one of said piston heads causing the volume of said snubbing chamber to decrease as said floating piston moves toward the adjacent cylinder head so that the air within the snubbing chamber acts to snub the motion of the cushion assembly, said stop means permitting the piston head and cushion assembly to move a portion of its travel disengaged from said floating piston so that the pressurized air in the snubbing chamber does not affect the cushion action of the cushion assembly, the presence of air in the snubbing chamber at at least the first predetermined pressure retaining the compression ratio of the air within the snubbing chamber to snub the cushion assembly substantially constant over the range of the first predetermined pressure to snub the motion over a relatively constant time interval and stroke length over the range of the first predetermined pressure;

the air in said snubbing chamber acting to open the snubber valve means at a predetermined pressure permitting flow of air through said snubber valve means and alleviating the snubbing of said cushion assembly, the predetermined pressure being dependent upon the numer of cushion chambers within the cushion assembly, the limitation of volume of the snubbing chamber by said stop means permitting the snubbing action to be performed relatively independently of the stroke length of the cushion assembly and minimizing the flow of air through said snubber valve means necessary to alleviate the snubbing action to render the duration of snubbing action relatively independent of stroke length and the first predetermined pressure and reduce the heat of compression of air within the snubbing chamber necessary to perform the snubbing action over that possible by snubbing the motion of the cushion assembly in a snubbing chamber filled with air supplied from an atmospheric pressure source;

said orifice controlling the flow of air from said snubbing chamber through said snubber valve means, said means defining said orifice being removable to allow a second means defining an orifice having a modified orifice dimension to be secured to said snubber valve means to permit the snubber apparatus to be employed with varied cushion assembly velocities and cushion chamber pressures; and said check valve replenishing the air flowing through said snubber valve means, the air moving said floating piston away from said adjacent cylinder head to increase the volume of said snubbing chamber as the cushion assembly is yieldably deformed.

22. A method for snubbing the motion of an air cushion in a forming press, the air cushion operating with the air therein at a first predetermined pressure exceeding atmospheric pressure, the air cushion moving between first and second positions, comprising the steps of:

forming a snubbing chamber having a volume variable in response to the motion of the air cushion between the first position and a disengagement position, the disengagement position disposed between the first and second positions;

maintaining the volume of the snubbing chamber at a constant value as the air cushion moves between the disengagement and second positions, the maximum volume of the snubbing chamber being maintained independent of the distance between the disengagement and second positions;

supplying air to the snubbing chamber at the first predetermined pressure through a check valve;

providing a snubber valve for communication between the snubbing chamber and the atmosphere;

biasing the snubbing valve in a closed position to prevent airflow therethrough to the atmosphere;

decreasing the volume of the snubbing chamber to compress the air therein above the first predetermined pressure and snub the motion of the member when the air cushion moves past the disengagement position toward the first position such that an opposing force is presented to the air cushion;

exposing a first area on the snubber valve to the pressure in the snubbing chamber acting to open the snubber valve to permit flow of air through the snubber valve to the atmosphere;

exposing a second area on the snubber valve to the first predetermined pressure acting to close the snubber valve and opposing the effect of the pressure in the snubbing chamber to cause the opening of the snubber valve to be dependant on the difference between the first predetermined pressure and the pressure in the snubbing chamber; and selecting the ratio of the first and second areas on the snubber valve to open the snubber valve at a second, higher predetermined pressure to alleviate the snubbing of the air cushion.

23. The method of claim 22 further comprising the step of controlling the flow of the air through said snubber valve means by an orifice.

24. A method for snubbing the motion of an air cushion having at least one cushion chamber and having a range of motion between a top stroke position and a second position for use in a forming press, the air cushion being repeatedly deformed to cushion a member in the forming press, comprising the steps of:

maintaining the air pressure in the cushion chamber at a first variable predetermined pressure within the range of pressures exceeding atmospheric pressure;

forming a snubbing chamber having a volume variable in response to the motion of the air cushion between the top stroke position and a disengagement position, the disengagement position disposed between the top stroke and second positions;

limiting the maximum volume of the snubbing chamber to a constant value as the air cushion moves through the disengagement position toward the second position such that the maximum volume of the snubbing chamber is maintained independent of the range of motion of the air cushion between the disengagement position and the second position;

positioning a check valve between the cushion chamber and the snubbing chamber so that air flows to the snubbing chamber when the pressure in the snubbing chamber falls below the first predetermined pressure;

providing a snubber valve to communicate between the snubbing chamber and the atmosphere;

biasing the snubber valve in a closed position with pressure from the air in the cushion chamber to prevent air flow therethrough;

decreasing the volume of the snubbing chamber as the air cushion passes through the disengagement position and returns to the top stroke position compressing the air therein to snub the motion of the air cushion, the presence of air in the snubbing chamber at at least the first predetermined pressure maintaining the compression ratio of the air within the snubbing chamber to snub the cushion assembly substantially constant over the range of the first predetermined pressure and to snub the motion over a relatively constant time duration and stroke length for the range of first predetermined pressures;

alleviating the snubbing of the motion of the air cushion when the air in the snubbing chamber reaches a second, higher predetermined pressure opening the snubber valve to permit flow of the air through the snubber valve to the atmosphere, the second predetermined pressure being dependent upon the first predetermined pressure; and controlling the rate of flow through the snubber valve by an orifice of predetermined size, the size of the orifice being varied to compensate for varied cushion chamber air pressures and air cushion velocities.

25. The method of claim 24 further comprising the step of setting the second, higher predetermined pressure in response to the number of cushion chambers within the air cushion.

26. The method of claim 24 further comprising the steps of:

increasing the volume of said snubbing chamber as the air cushion is deformed from the top stroke position by the force exerted by the air from said cushion chamber flowing into said snubbng chamber through said check valve; and providing stop means to limit the volume of said snubbing chamber, said stop means permitting the cushion assembly to move a portion of its travel without being affected by the pressurized air in said snubbing chamber, the limitation of volume in said snubbing chamber causing the snubbing action to be performed independently of stroke length and minimizing the flow of air through said snubber valve means to alleviate the snubbing action to render the duration of snubbing action relatively independent of stroke length and the first predetermined pressure and minimizing the heat of compression of the air within said snubbing chamber during the snubbing action.

27. A forming press for forming a material, comprising:

a frame;

cooperating first and second dies for forming the material, said first die being mounted for reciprocal motion toward and away from said second die, said second die being mounted on said frame for limited motion upon contact by said first die through the material to be formed;

a cushion assembly for cushioning said second die upon contact with said first die through the material, said cushion assembly comprising:

a first body secured in a fixed relationship to said frame;

a second body for motion relative to said first body and moving with said second die;

a piston shaft secured to said second body and extending into said first body;

at least one piston head means attached along the length of said piston shaft and within said first body;

at least one cylinder head means attached within said first body;

said first body, said second body, said piston shaft, said piston head means and said cylinder head means defining a plurality of cushion chambers, said cushion chambers being variable in volume and adapted for receiving compressed air therein at a first variable predetermined pressure within a range of pressures to permit the cushion assembly to yieldably deform to cushion the contact between the first and second dies;

floating piston means positioned between at least one of said cylinder head means and at least one of said piston head means and defining a snubbing chamber between said floating piston means, said first body and said at least one cylinder head means;

stop means mounted on said first body for limiting the motion of said floating piston means from said at least one cylinder head means, said at least one cylinder head means having first and second recesses formed therein and said first body having first and second openings therethrough permitting access to the first and second recesses, respectively, said at least one cylinder head means further having ports communicating with at least one cushion chamber and the snubbing chamber opening into each of said recesses;

snubber valve means for mounting in said first recess having an inlet communicating with said snubbing chamber and an exhaust communicating with the atmosphere through the first opening in said first body;

the air in at least one of said cushion chambers biasing said snubber valve means in a closed position, preventing flow of air therethrough;

said snubber valve means further defining an orifice of predetermined dimension in the exhaust of said snubber valve means for communication with the atmosphere to control the flow of air therethrough, the dimension of said orifice being variable to snub the motion of the cushion assembly with a range of cushion chamber air pressures and cushion assembly velocities;

a check valve mounted in said second recess communicating with said snubbing chamber and at least one cushion chamber, said check valve permitting air to flow therethrough when the air pressure within said snubbing chamber decreases below the first predetermined pressure;

said at least one piston head means contacting said floating piston means as the cushion assembly returns to the undeformed state and causing the air within the snubbing chamber to be compressed to snub the motion of the cushion assembly;

the air within said snubbing chamber opening said snubber valve means at a second, higher predetermined pressure to permit flow of the air through said snubber valve means and said orifice to alleviate the snubbing of said cushion assembly, said snubber valve means closing after the pressure in said snubbing chamber is insufficient to counteract the air pressure in said cushion chamber biasing said snubber valve means in the closed position, the presence of air in the snubbing chamber at at least the first predetermined pressure retaining the compression ratio of the air within the snubbing chamber to snub the cushion assembly substantially constant over the range of the first predetermined pressure to snub the motion over a relatively constant time interval and stroke length over the range of the first predetermined pressure, the limitation of volume in the snubbing chamber causing the snubbing action to be performed independently of stroke length and minimizing the flow of air through the snubber valve means to alleviate the snubbing action to render the duration of snubbing action relatively independent of stroke length and the first predetermined pressure, the heat of compression of the air within the snubbing chamber also being minimized; and said frame having openings therein to permit access to the first and second openings within said first body to permit removal and replacement of said snubber valve means and check valve.

28. A snubber apparatus for snubbing the motion of a member in a press, the member having a range of motion between a first and second position, comprising:

cushion means for cushioning the motion of the member as the member traverses from the first to the second position in its range of motion; and snubbing means for snubbing the motion of the member as the member moves from the second position to the first position in its range of motion, said snubbing means operating over only a portion of the range of motion of the member to provide a constant snubbing action that is independent of the displacement of the member over its range of motion such that changes in the range of motion of the member do not result in changes in the snubbing action.

29. The apparatus of claim 28 wherein said cushion means comprises an air cushion having a variable volume, said variable volume in communication with a source of compressed air at a predetermined pressure.

30. The apparatus of claim 28 wherein said snubbing means comprises:

a snubbing chamber having a variable volume, the volume of said snubbing chamber increasing to a maximum as the member moves from the first position in its range of motion to a disengagement position, the displacement between the first position and said disengagement position less than the displacement between the first and second positions, the volume of said snubbing chamber decreasing to a minimum as the member moves from said displacement position to the first position;

check valve means in communication with a source of air at a first predetermined pressure for permitting said snubbing chamber to increase in volume with minimal resistance by allowing the air to fill said snubbing chamber; and snubber valve means for releasing the air within the expanded volume thereof when the pressure therein exceeds a second predetermined pressure resulting from movement of the member from said disengagement position to the first position thereby decreasing the volume in said snubbing chamber.

31. A snubber apparatus for snubbing the motion of a reciprocating member in a press, the reciprocating member reciprocating between first and second positions, comprising:

an air cushion attached to the reciprocating member along the reciprocating axis thereof for providing a resistive force as the reciprocating member moves from the first to the second position, said air cushion filled with air at a first predetermined pressure;

a snubbing chamber having a variable volume, the volume of said snubbing chamber increasing to a maximum as the reciprocating member reciprocates from the first position to a disengagement position wherein further reciprocation of the reciprocating member towards the second position does not affect the volume of said snubbing chamber, the displacement between the first position and said displacement position less than the displacement between the first and second positions, the volume of said snubbing chamber decreasing to a minimum as the reciprocating member reciprocates from said displacement position to the first position;

a check valve disposed between the air in said cushion chamber and the interior of said snubbing chamber for permitting said snubbing chamber to increase in volume to fill said snubbing chamber with air at the first predetermined pressure; and a snubber valve for releasing the air within the expanded volume of said snubbing chamber when the pressure therein exceeds a predetermined pressure resulting from movement of the member from the disengagement position to the first position which compresses the volume of said snubbing chamber thereby snubbing the motion of the member.

* * * * *